United States Patent [19]

Miles et al.

[11] Patent Number: 4,615,777

[45] Date of Patent: Oct. 7, 1986

[54] METHOD AND COMPOSITION FOR REDUCING THE VOLTAGE IN AN ELECTROLYTIC CELL

[75] Inventors: Ronald C. Miles; David D. Justice; Garland E. Hilliard, all of Cleveland, Tenn.

[73] Assignee: Olin Corporation, Cheshire, Conn.

[21] Appl. No.: 444,299

[22] Filed: Nov. 24, 1982

[51] Int. Cl.[4] ..... C25B 1/02; C25B 1/34

[52] U.S. Cl. ..... 204/129; 204/98; 204/128

[58] Field of Search ..... 204/98, 128, 129

[56] References Cited

U.S. PATENT DOCUMENTS 4,105,516 8/1978 Martinsons et al. ..... 204/129
4,127,468 11/1978 Alfenaar et al. ..... 204/129
4,160,704 7/1979 Kuo et al. ..... 204/98
4,230,543 10/1980 Kawasaki et al. ..... 204/98
4,315,805 2/1982 Darlington et al. ..... 204/128

*Primary Examiner*—John F. Niebling
*Assistant Examiner*—Terryence Chapman
*Attorney, Agent, or Firm*—James B. Haglind; Thomas P. O'Day

[57] ABSTRACT

The cell voltage of an electrolytic cell having an anode compartment separated from a cathode compartment, the cathode compartment containing an alkaline catholyte solution is reduced in a method which comprises introducing into the cathode compartment a compound of a heavy metal selected from Groups IVB, VB, and VIB and an alkylene polyamino complex with cobalt or iron. The method results in significant cell voltage reductions in electrolytic cells employing as separators porous diaphragms or ion exchange membranes.

1 Claim, No Drawings

METHOD AND COMPOSITION FOR REDUCING THE VOLTAGE IN AN ELECTROLYTIC CELL

This invention relates to the production of hydrogen gas in an electrolytic cell. More particularly, it relates to a process and composition for reducing the cell voltage in electrolytic cells for producing hydrogen gas by the electrolysis of an alkaline catholyte.

In electrolytic processes in which hydrogen gas is produced at the cathode in an electrolytic cell having a cathode compartment containing an alkaline catholyte, it is very important from the viewpoint of operating costs to minimize the hydrogen overvoltage. Hydrogen overvoltage, H, is defined by the equation:

$$H = Ei - Eo,$$

where Ei is the electrode potential under load, and Eo is the reversible potential.

Prior art methods for lowering the hydrogen overvoltage include those in which a cathode of a base material is plated with a metal such as a transition metal or a noble metal. In U.S. Pat. No. 4,160,704, issued Aug. 8, 1978, to H. C. Kuo et al, ions of low overvoltage metals such as iron, cobalt, tungsten, nickel, chromium, molybdenum, vanadium, or the platinum metals group, are introduced into the cathode chamber of an electrolytic cell and electroplated onto the base material. A complexing agent such as ammonium citrate, ammonium pyrophosphate, sodium pyrophosphate, sodium citrate, ammonium tartrate, sodium tartrate and ammonium hydroxide may be present to sequester or chelate the low overvoltage metal. During the electroplating operation, the electrolytic process is discontinued.

U.S. Pat. No. 4,105,516, issued Aug. 8, 1978, to A. Martinsons et al describes a method of reducing the hydrogen overvoltage in an electrolytic cell for electrolyzing alkali metal chloride brines by the semi-continuous addition of a compound of a transition metal such as iron, cobalt, nickel, chromium and manganese to the catholyte or anolyte. Inorganic compounds of the transition metals include chlorides, hydroxides, and oxychlorine compounds. Organic compounds including a chelating agent such as triethanolamine, alpha amino acids, dicarboxylic acids, beta carbonyls, ethylene diamines and hydroxy acids may be employed in the method; and when employed, the stoiochiometric excess of the organic compound may be mixed with the inorganic metal compound. This method requires frequent additions of the compound as the voltage reduction is short-lived.

Therefore there is required a method for reducing the cell voltage in an electrolytic cell which can be employed while the cell is in operation; which maintains the voltage reduction without requiring frequent application of the method and which also minimizes the contamination of the catholyte solutions.

It is an object of the present invention to provide a method for reducing the cell voltage in an electrolytic cell while the cell is in operation.

Another object of the present invention is to provide to provide a method for reducing the cell voltage for an extended time period between applications.

A further object of the present invention is a method for reducing the cell voltage while minimizing contamination of catholyte solutions.

A still further object of the present invention is to provide a novel composition for reducing the cell voltage in an electrolytic cell.

These and other objects of the invention are provided in a method for reducing the cell voltage of an electrolytic cell having an anode compartment separated from the cathode compartment, the cathode compartment containing an alkaline catholyte solution and producing hydrogen gas, the method which comprises introducing into the cathode compartment a compound of a heavy metal selected from Groups IVB, VB, and VIB and an alkylene polyamino complex with cobalt or iron.

More in detail, the novel electrolytic method of the present invention is carried out in an electrolytic cell in which the cathode compartment, containing at least one cathode, is isolated from the anode compartment by a separator. The cathode compartment contains an alkaline catholyte solution, such as an aqueous solution of an alkali metal hydroxide or an alkali metal carbonate. During electrolysis, hydrogen gas is produced at the cathode and is recovered by known methods.

To reduce the cell voltage during operation of the electrolysis process, a heavy metal of Groups IVB, VB, or VIB of the Periodic Table is introduced into the cathode compartment. Suitable heavy metals include titanium, vanadium, niobium, tantalum, chromium, molybdenum, and tungsten. Also suitable are mixtures of heavy metals such as a mixture of chromium and molybdenum. The heavy metal is added as a compound in which the metal may be present as the cation or as a component of an anion group. Suitable compounds include oxides such as titanium dioxide, vanadium pentoxide, tungsten dioxide, niobium monoxide, niobium pentoxide, tantalum pentoxide and chromium sesquioxide hydrates; chlorides including titanium chlorides, vanadium dichloride, tungsten hexachloride, niobium pentachloride, chromium chloride hexahydrate, dimolybdenum oxydichloride; metavanadic acid and tetravanadic acid; alkali metal chromates such as sodium chromatie; alkali metal molybdates such as sodium molybdate; and tungstic acid. Preferred heavy metals are those of Group VIB, chromium, molybdenum, and tungsten, with molybdenum being most preferred. Suitable Group VIB heavy metal compounds include chromic acid, alkali metal chromates, alkali metal molybdates, tungsten dioxide and tungstic acid.

Also added to the cathode compartment is an alkylene polyamino complex of cobalt or iron. Suitable alkylene polyamine ligands include ethylene diamine, diethylene diamine, triethylene diamine, triethylene triamine, tetraethylene triamine, tetraethylene tetramine, and hexamethylene tetramine. Preferred as alkylene polyamino ligands are ethylene diamine, diethylene diamine, and riethylene diamine, with triethylene diamine being particularly preferred.

The complexes with cobalt or iron are prepared, for example, by adding the alkylene polyamine chelating agent to an aqueous solution of the metal ion's chloride or nitrate salt. Then, in the case of cobalt, the metal ion is allowed to air-oxidize. The solution is concentrated by boiling off some of the water solvent. It is then neutralized by adding concentrated hydrochloric acid. The addition of ethanol will cause the complex ion to precipitate.

The heavy metal compound and the alkylene polyamine complex of cobalt or iron may be added separately, but simultaneously to the alkaline catholyte solution or the compounds may be premixed and the mixture added to the cathode compartment. In a preferred embodiment, the heavy metal compound and/or the alkylene polyamino complex are dissolved in an aqueous solution of the alkaline compound used as the catholyte and the solution introduced into the cathode compartment. For example, a heavy metal compound such as sodium molybdate and/or an alkylene, polyamino complex of cobalt such as trisethylenediamine cobalt(III) chloride trihydrate are dissolved in an aqueous solution of an alkali metal hydroxide such as sodium hydroxide, and the resulting solution is fed to the cathode compartment. Where one component is dissolved in the alkaline solution, the other component is added to the cathode compartment separately.

Addition of the heavy metal compound and the alkylene polyamine complex is made while the cell is in operation. A solution of additives readily mixes with the cell catholyte and stirring of the mixture is provided by copious effervescence which takes place in the cathode chamber of electrolytic cells. Where the additives are added as dry powders, they quickly dissolve and mix in the hot, concentrated alkaline catholyte.

Any proportions of heavy metal compound to alkylene polyamino complex of Co or Fe may be used. For example, molar ratios of heavy metal compound to alkylene polyamino complex of from about 1:10 to about 2:1 may be employed. Preferably the molar ratios of heavy metal compound to alkylene polyamino complex are in the range of from about 1:8 to about 3:6.

Any suitable amount of the heavy metal compound and the alkylene polyamino complex of Co or Fe mixture may be added to the catholyte solution which will result in a substantial reduction of the cell voltatge. For example, from about 1 to about 50 grams, preferably from about 5 to about 40 grams, and more preferably from about 15 to about 30 grams of the mixture are employed per liter of catholyte solution.

Upon addition of the heavy metal compound and the alkylene polyamino complex to the electrolytic cell in operation, the cell voltage is quickly reduced. Following the immediate cell voltage reduction, the cell voltage will rise slightly to an intermediate voltage which is substantially lower than the original cell voltage. The reduced cell voltage is maintained for an extended period of time, for example, at least 7 days and preferably from about 14 to about 270 days without requiring a further addition of the heavy metal compound and the alkylene polyamino complex. The cell voltage reduction is normally at least about 100 millivolts.

Electrolytic cells in which the novel method of the present invention may be employed include those used commercially for the production of halogens, such as chlorine or bromine, and solutions of an alkali metal hydroxide, for example, sodium hydroxide or potassium hydroxide or an alkali metal carbonate such as sodium carbonate. As is well known, these cells electrolyze an alkali metal halide solution such as sodium chloride or potassium bromide to produce the halogen gas in the anode compartment and hydrogen gas and an alkali metal catholyte solution in the cathode compartment.

The novel method of the present invention is also suitable for use in electrolytic cells for the production of oxygen and hydrogen by the electrolysis of an alkaline solution such as an alkali metal hydroxide solution.

Separators used to isolate the gas produced at the anode from the hydrogen gas produced at the cathode include those which permit the bulk flow of electrolyte, such as asbestos diaphragms, or those which substantially inhibit the bulk flow of the electrolyte, but permit the passage of ions, for example, ion-exchange membranes.

Suitable as ion-exchange membranes are cation exchange membranes including, for example, perfluorocarbon polymers having as functional groups carboxylic acid groups and/or sulfonic acid groups. These membranes described in U.S. Pat. No. 4,178,218, issued Dec. 11, 1979, to M. Seko; U.S. Pat. No 4,065,366 issued Dec. 27, 1977 to Y. Oda et al; and U.S. Pat. No. 4,255,240, issued March 10, 1981 to C. J. Molnar et al. These cation exchange membranes are commercially available, for example, as NAFION cation exchange membranes from E. I. duPont de Nemours & Company and FLEMION cation exchange membranes from the Asahi Glass Co.

Cathodes which may be used in the cathode compartment include any of those which are used, generally in a foraminous form, in cells for the production of hydrogen gas, and include those comprised of metals, such as nickel, steel, and titanium.

Employing the novel method of the present invention results in a substantial reduction of the cell voltage during operation of the electrolytic cell. By employing small amounts and infrequent additions of the heavy metal compound and the alkylene polyamino complex of Co or Fe, contamination of the catholyte solution produced in the cathode compartment is minimized.

The following examples are illustrative of the method of this invention.

EXAMPLE 1

An electrolytic cell which was operated with a $RuO_2/TiO_2$ coated titanium anode and a nickel mesh cathode in contact with a cation exchange membrane. The membrane employed in the cell was a Flemion cation exchange membrane (Asahi Glass Corp.) having carboxylic acid functional groups which was designed to be operated while in contact with the cell electrodes. The cell was operated to produce chlorine gas, hydrogen gas and NaOH with 240 g/l aqueous sodium chloride as the anolyte and a 35% aqueous sodium hydroxide solution as the catholyte. At 3.0 KA/sm, the cell voltage was 3.38 volts. A dry mixture consisting of 2.178 g of sodium molybdate and 5.994 grams of triethylene diaminecobalt(III) chloride (molar ratio 3:5) was prepared and added to the cathode chamber in three approximately equal weight increments. The second increment was added after two hours and the third, three hours after the initial addition. The cell voltage had dropped as low as 3.19 volts by the end of the addition period. The next day, the cell voltage was 3.25 volts where it remained for two weeks until the cell was shut down.

EXAMPLE 2

An electrolytic cell employing a Nafion cation exchange membrane (E.I. duPont de Nemours and Company) was operated with 240 g/l NaCl in the anode compartment and 33% NaOH in the cathode compartment. The anode and cathode were $RuO_2/TiO_2$ coated titanium and nickel meshes respectively. The cell was operated with the membrane in contact with the anode, but spaced apart from the cathode. The products of the cell were chlorine gas, hydrogen gas, and aqueous sodium hydroxide. The cell operated at about 3.79 volts at 3.0 KA/sm current density. The cathode voltage measured vs. a Pd/H reference electrode was 0.385 volts.

Sodium molybdate (2.189 grams) and 5.982 grams of triethylene diaminecobalt(III) (molar ratio 3:5) were dissolved in 300 ml of 33% aqueous sodium hydroxide and the solution added to the cell. Immediately upon adding the solution, the cell voltage dropped to 3.61 volts. By the next day, the cell voltage had risen to 3.73 volts, but after four days of operation, the voltage had fallen to 3.63 volts. The cathode voltage vs. a Pd/H reference electrode measured 0.235 volts for several days after the addition. The cell voltage continued to decrease until, ten days later, it was 3.28 volts when cell operation was discontinued.

EXAMPLE 3

The electrolysis process of EXAMPLE 1 was carried out in a cell of the type of EXAMPLE 2 at a current density of 3.0 KA/sm and a cell voltage of 3.38 volts. The cell was operated with 250 g/l aqueous sodium chloride in the anode chamber and 33% aqueous sodium hydroxide in the cathode chamber. A dry mixture of 0.738 grams sodium molybdate and 6.098 grams triethylenediamine cobalt(III) chloride (molar ratio 1:5) was added to the cathode chamber in five equal increments 1 hour apart. During the addition process, the cell voltage was seen to go as low as 3.15 volts. The next day, the cell voltage was 3.28 volts. The lowered voltage was maintained for a week following the addition of the mixture, after which the cell was shut down.

What is claimed is:

1. A method for reducing the cell voltage of an electrolytic cell having an anode compartment separated from a cathode compartment, said cathode compartment containing an alkaline catholyte solution and producing hydrogen gas, said method which comprises introducing into said cathode compartment trisethylenediamine cobalt III and sodium molybdate.

* * * * *

UNITED STATES PATENT AND TRADEMARK OFFICE

CERTIFICATE OF CORRECTION

PATENT NO. : 4,615,777

DATED : October 7, 1986

INVENTOR(S) : Ronald C. Miles et al.

It is certified that error appears in the above-identified patent and that said Letters Patent is hereby corrected as shown below:

Column 2, line 40, "chromatie" should read -- chromate --.

Column 2, line 54, "riethylene" should read -- triethylene --.

Column 3, line 33, "voltatge" should read -- voltage --.

Signed and Sealed this

Ninth Day of December, 1986

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,615,777

DATED : October 7, 1986

INVENTOR(S) : Ronald C. Miles et al.

It is certified that error appears in the above-identified patent and that said Letters Patent is hereby corrected as shown below:

Column 4, Example 1, line 45, delete "trieth-" and insert -- triseth --.

Column 5, Example 2, line 2, delete "triethylene" and insert -- trisethylene --.

Column 6, Example 3, line 2, delete "tri-" and insert -- tris --.

Signed and Sealed this

Third Day of February, 1987

*Attest:*

DONALD J. QUIGG

*Attesting Officer*

*Commissioner of Patents and Trademarks*